United States Patent [19]

Lowe et al.

[11] 3,976,741

[45] Aug. 24, 1976

[54] BUILDING CONSTRUCTION

[75] Inventors: James N. Lowe; Earl Gregory, both of Memphis, Tenn.

[73] Assignee: ISG International Incorporated, Memphis, Tenn.

[22] Filed: Oct. 29, 1971

[21] Appl. No.: 193,789

[30] Foreign Application Priority Data

Nov. 17, 1970 United Kingdom ..... 54650/70

[52] U.S. Cl. ..... 264/256; 264/35; 264/327; 264/333; 264/336; 264/338

[51] Int. Cl.[2] ..... B28B 1/16

[58] Field of Search ..... 264/334, 336, 338, 34, 264/256, 35, 333, 42, 255, 319, 327; 249/134, 144

[56] References Cited

UNITED STATES PATENTS

| | | | |
|---|---|---|---|
| 1,862,323 | 6/1932 | Straub | 264/319 |
| 2,201,359 | 5/1940 | Whited | 249/144 |
| 2,616,146 | 11/1952 | Haase | 264/255 X |
| 2,851,330 | 9/1958 | Taylor | 264/338 |
| 3,455,074 | 7/1969 | Rice | 264/35 X |
| 3,459,571 | 8/1969 | Shannon | 264/42 |

FOREIGN PATENTS OR APPLICATIONS

| | | | |
|---|---|---|---|
| 127,170 | 8/1959 | U.S.S.R. | 249/27 |

*Primary Examiner*—Robert F. White
*Assistant Examiner*—Thomas P. Pavelko
*Attorney, Agent, or Firm*—Brisebois & Kruger

[57] ABSTRACT

Box-like units having at least one open side for use, for example, in the construction of prefabricated buildings are cast from a composition of gypsum and water optionally including other material such as Portland or Aluminous cement. The mixture is cast between an external mould defining the external faces of the unit and an internal core defining the internal faces of the unit and the core is formed from, or covered with, material which causes its faces which come into contact with the mixture to have a higher coefficient of heat reflection than that of the faces of the external mould which come into contact with the mixture. The mixture is allowed to set and the external mould is removed, after which the mixture is allowed to harden further and during this hardening becomes heated by the exothermic reaction between the gypsum and the water to cause the hardened mixture to expand away from the core. This allows the core to be subsequently removed without it being necessary to make the core collapsible.

12 Claims, 15 Drawing Figures

Inventor

By

Attorney

Fig. 2
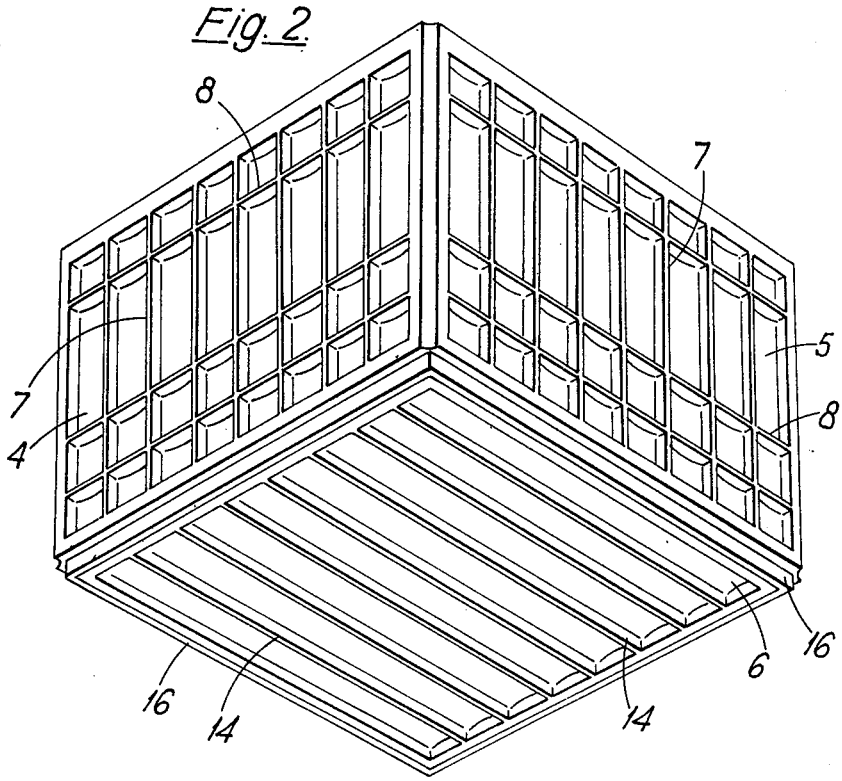
Fig. 7
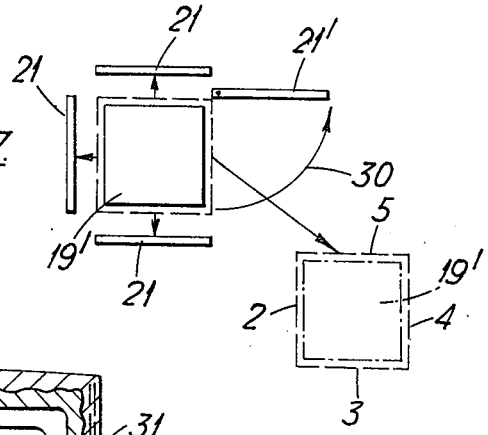
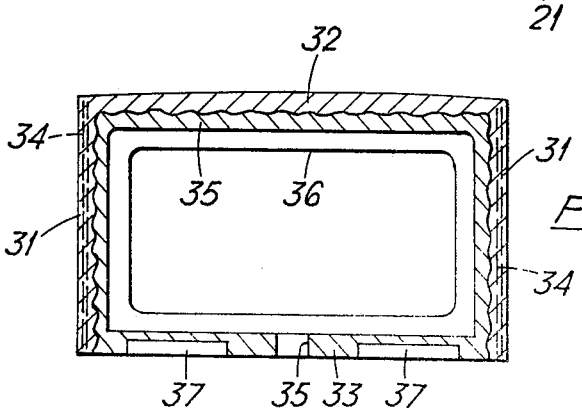
Fig. 8
Inventor
By
Attorney

*Inventor*

*By*

*Attorney*

Inventor

By

Attorney

Inventor

By

Attorney

BUILDING CONSTRUCTION

This invention relates to a method of construction of box-like units having at least one open side from a mixture of a hydraulic binding agent and water or a mixture containing a hydraulic binding agent and other material with water.

By a hydraulic binding agent is meant gypsum or a mixture of gypsum and a cementitious material, for example Portland or Aluminous cement which, when mixed with water, reacts with the water and subsequently sets and hardens to form a solid material, the reaction with the water being exothermic.

The box-like units may be used for various purposes, for example as large packing cases for container transport or for purposes in the construction industry such as for forming pre-fabricated tunnel or culvert sections. A particularly important use for the units is in pre-fabricated building construction in which a number of such units, which form the rooms or other spaces within a building, are fixed together side by side and in one or more layers. An example of this form of construction, in which, after the units have been fixed together, structural concrete is placed between them, is described in U.S. Pat. No. 3,331,170. For many purposes, and in particular in pre-fabricated building construction, the open side or sides of the box-like unit may subsequently be closed by the formation of an additional wall forming a bottom or cover.

When such box-like units are cast by placing a mixture of water and a composition including a hydraulic binding agent in a mould with a central core forming the internal hollow space of the unit, the hydraulic binding agent or the composition containing the hydraulic binding agent expands as it sets and hardens and it is found that this expansion takes place both inwards and outwards from approximately the centre of the thickness of the walls of the unit. In consequence the core is firmly gripped by the surrounding material and to enable it to be removed, it has always been necessary to make the core collapsible. This adds very greatly to the cost of manufacturing the units.

The present invention provides a method by which such box-like units may be cast from a mixture of water and a composition including a hydraulic binding agent in a very simpler manner than has previously been possible so that the casting operation is made very much more rapid and therefore more economical.

To this end, according to this invention, such a mixture is prepared and is cast between an external mould defining the external faces of the unit and an internal core defining the internal faces of the unit, the core being formed from or covered with material which causes its faces which come in contact with the mixture to have a higher coefficient of heat reflection than that of the faces of the external mould which come into contact with the mixture, the mixture is allowed to set and the external mould is removed, after which the mixture is allowed to harden further and the internal core is removed, the time which elapses between the start of the removal of the external mould and the start of the removal of the core being greater than that which elapses between the completion of casting and the start of the removal of the external mould, but removal of the internal core being completed while the mixture is still heated by its exothermic reaction.

We have made the surprising discover that when, in accordance with the invention, the external mould is removed as soon as the mixture has set and has gained sufficient strength to be self-supporting, and the core has a higher coefficient of heat reflection than the external mould, the subsequent expansion of the mixture which takes place as it hardens after removal of the mould, takes place in an outward direction only or at least to a very major extent in an outward direction. Therefore at the end of the time allowed for the mixture to harden and gain in compressive strength, the box-like unit has expanded away from the core and the core can quite easily be removed without it being necessary to collapse it or to dismantle it in any way and also without damaging the unit.

The core can therefore be constructed very much more cheaply than one which has to be collapsible and its removal from the cast box-like unit is so greatly facilitated that there is a considerable saving in labour time and therefore in cost as well.

Preferably the internal core comprises a rigid base coated with heat reflecting material. This heat reflecting material may consist, for example, of sheeting of polyethylene or polytetrafluoroethylene or of these materials applied by spray coating. Polyethylene and polytetrafluoroethylene are particularly suitable since they also provide an excellent surface finish on the cast mixture and prevent adhesion from occurring between the cast mixture and the core.

Although the composition may contain some inert filler such as sand, it preferably consists of a major proportion of gypsum mixed with Portland or Aluminous cement, or wholly of gypsum except for minor additives such as plasticisers and wetting agents which may also be present.

In recent years a range of gypsums have been developed which when mixed with water and allowed to set have different wet and dry compressive strengths and different setting times from each other. Thus at the lower end of the range is plaster of paris which has very little wet strength immediately after setting and the properties of the range of gypsums vary from this up to what are known as the "super-gypsums" which may have a wet strength immediately after setting of 6000 psi and a subsequent dry strength of up to 14,000 psi. Other gypsums are available having strengths in between those of plaster of paris and super-gypsum and these are subsequently referred to in this Specification as "middle gypsums".

A mixture of gypsum with as little as 4% by weight of water provides a slurry of a creamy consistency which can be introduced into the space between the external mould and the internal core very much more easily and quickly, and consequently with a smaller labour cost, than can cement mortar or concrete. What is more, super-gypsum and the middle gypsums may, under properly controlled conditions, set extremely rapidly so that both the external mould and the core can be removed after short periods and a number of re-uses are possible in the course of the single working day.

The reaction between the gypsum and the water as setting and subsequent hardening takes place is highly exothermic and, using a mixture of super-gypsum and water alone, except for minor proportions of additives such as plasticising agents and wetting agents, there may be a gap of between 1/10th inch and ¾ inch between the faces of the core and the box-like unit when the unit has dimensions of about 12 by 12 by 8 ft. This enables the core to be removed very easily.

Once the external mould has been removed, the external face of the cast box-like unit is exposed to the surrounding atmosphere and there is therefore a heat gradient through the walls of the unit from the core to the outside face. It is believed that it is this heat gradient which brings about the outward expansion of the unit as it continues to harden. The actual expansion away from the core achieved in practice may be very much greater than the theoretical expansion calculated from a known coefficient expansion of a solid piece of the cast mixture.

The box-like unit is preferably rectangular and it may then be cast with its open side lowermost. The core is then removed by relative vertical movement between the core and the unit and this may be brought about by lowering the core without disturbing the cast unit itself. Subsequently after further hardening has taken place, the cast unit is lifted from between the walls of the external mould which have previously been moved away from it. Alternatively the unit, when it is sufficiently strong, may be lifted from between the walls of the external mould at the same time as the core is lowered.

When the box-like unit is intended for use in pre-fabricated building construction in the manner already described, it is cast with five walls which form the sides and roof of the room or other space formed by the unit. It is subsequently necessary therefore to add a bottom to the unit to form the floor of the room or other space. This is preferably done by lifting the cast unit, after removal of the core, from between the walls of the external mould and immediately placing it on a further mould which defines the outside face of the bottom. The bottom is then cast in contact with the bottom mould and in contact with the bottom edges of the side walls of the unit and this bottom may be formed out of the same mixture as the remainder of the unit or of a different mixture.

Again, when the box-like unit is intended for use in pre-fabricated building construction, the side walls of the unit may be cast with the top of the external mould absent to facilitate the introduction of the mixture into the space between the side walls of the external mould and the core and, immediately after casting the side walls, the top of the external mould is placed in position and the top wall is cast. For this purpose an opening through the top wall of the mould is necessary to enable the mixture to be introduced.

When the top wall of the unit is cast after the side walls, different compositions may be used in the mixture from which the top wall is formed from that which the side walls are formed. This is done when it is necessary for the compressive strength of the top wall to be greater than that of the side walls after setting and hardening of the mixture.

We have found that with compositions consisting wholly or largely of gypsum, the ductility of the cast mixture after hardening can be substantially improved by incorporating fibrous reinforcement in it. The composition preferably contains from ½ to 1½% by weight of fibrous reinforcement and the preferred fibres are sisal having a length of about 1¼ inches. Glass fibres, or other fibres such as polypropylene fibres may alternatively be used, but sisal fibres have been found to be very effective and are cheaper than glass or plastics fibres.

An example of a method of making a box-like unit, together with some modifications, in accordance with the invention will now be described with reference to the accompanying drawings in which:

FIG. 2 is a perspective view of the unit shown in FIG. 1 as seen from the other side and from below;

Figure 1:
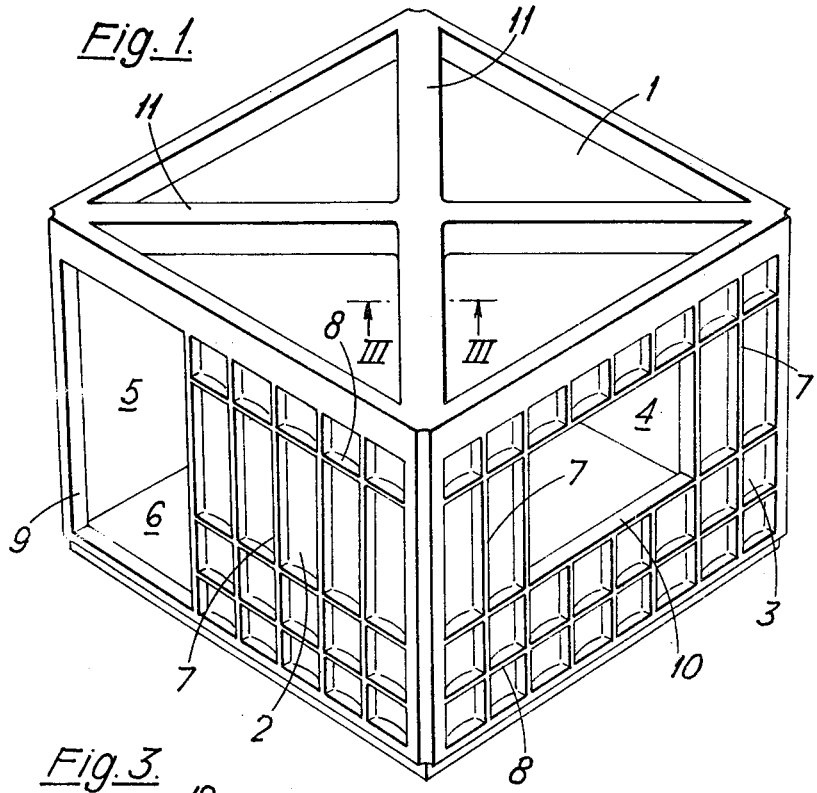
FIG. 1 is a perspective view from above of an example of a box-like unit made by a method in accordance with the invention.
Figure 9:
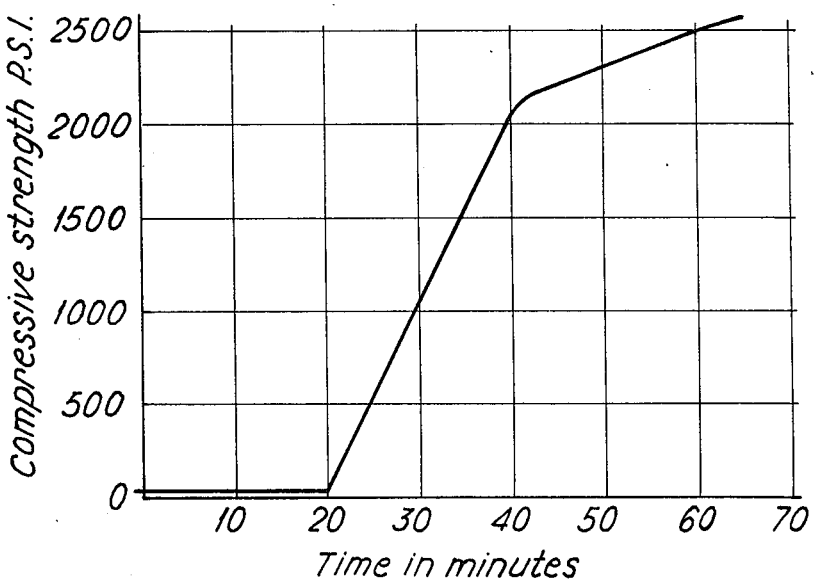
Figure 10:
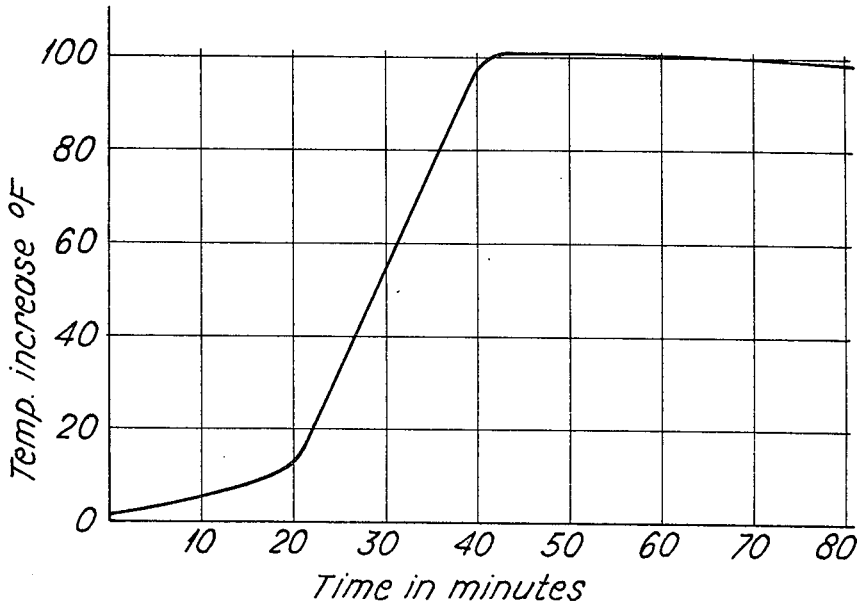
Figure 11:
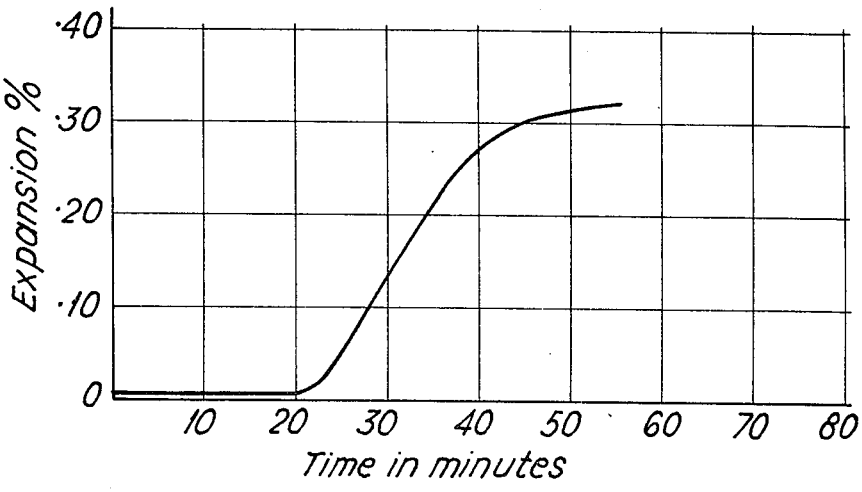

FIGS. 6*a* to 6*e* are diagrams illustrating successive stages in the construction of the unit shown in FIGS. 1 and 2;

FIG. 7 is a diagram showing a modification of one of the stages of construction described with reference to FIGS. 6*a* to 6*e*;

FIG. 8 is a somewhat diagrammatic cross-section through one example of a core which may be used in the construction of the unit shown in FIGS. 1 and 2; and, FIGS. 9 to 11 are graphs illustrating the physical properties of one example of a mixture used in the manufacture of units in accordance with the invention, FIG. 9 showing the compressive strength of the mixture, FIG. 10 the temperature increase of the mixture and FIG. 11 the expansion of the mixture all on a time base.

As shown in FIG. 1, a box-like unit intended for use in pre-fabricated building construction comprises a top 1, side walls 2, 3, 4 and 5 and a bottom 6. The side walls 2 to 5 and the top 1 are formed integrally leaving the bottom of the unit open and the bottom 6 is subsequently added.

Figure 3:
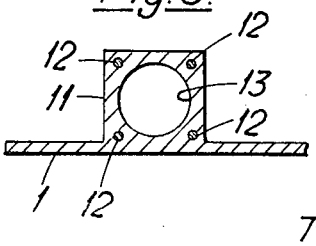
FIG. 3 is a section through a part of the unit shown in FIG. 1 as seen in the direction of the arrows on the line III—III in FIG. 1.

The side walls 2 to 5 are panelled with vertical ribs 7 and horizontal ribs 8, the side wall 2 being provided with a door opening 9 and the side wall 3 being provided with a window opening 10. The top 1 consists of a panel stiffened by diagonal beams 11. As shon in FIG. 3, the beams 11 are reinforced with bars 12 in their corners and are made hollow by means of a tubular core 13 which is necessarily left in-situ. As shown in FIG. 2, the bottom 6 is also stiffened by ribs 14 extending in one direction only.

Figure 4:
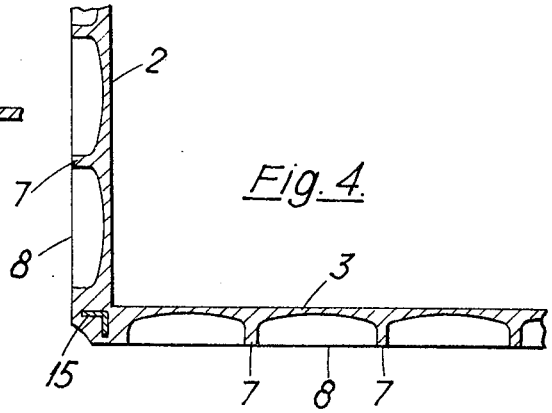
FIG. 4 is a sectional plan through one corner of the unit shown in FIGS. 1 and 2.

As shown in FIG. 4, each upright corner of the unit is reinforced with a cast-in steel angle section 15.

Figure 5:
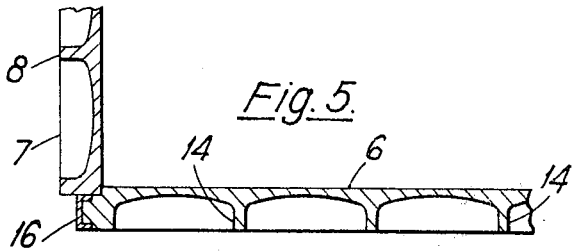
FIG. 5 is a section through the junction of one side wall and the bottom of the unit shown in FIGS. 1 and 2.

As shown in FIG. 5, the bottom 6 is surrounded by a rectangular steel frame 16 of channel-shaped cross-section.

The unit is formed in a series of stages illustrated diagrammatically in FIGS. 6*a* to 6*e* of the drawings. Casting of the unit takes place on a floor 17 shown in FIG. 6*c*. The floor 17 has a rectangular opening 18 through which an internal core 19 is movable upwards and downwards by hydraulic rams 20.

An external mould is formed by four side walls 21 all of which are movable on the floor 18 inwards and outwards towards and away from the core 19 by a further hydraulic rams 22. The external mould is completed by a top 23 which is movable upwards and downwards by hydraulic rams 24.

The side walls 21 and the top 23 are shown diagrammatically as having flat internal and external surfaces but they are in fact constructed from grillages of steel beams with metal plates on their inner faces. The metal plates are provided with formers to form the surface profile of panels with the vertical and horizontal ribs 7 and 8 respectively as shown in FIGS. 1 and 2.

Figure 6A:
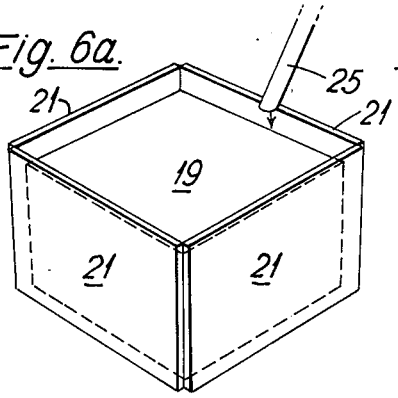

Initially, the core 19 is raised and the side walls 21 are moved inwards surrounding but spaced from the core 19 as shown in FIG. 6*a*. At this stage the top 23 is also raised, but it is omitted from FIG. 6*a* for clarity. Before the side walls 21 are moved inwards, frames are attached to them to form the door and window openings 9 and 10 in the finished unit. Further, the reinforcing bars 12, the angle sections 15 and the channel-sectioned frame 16 are all set in position together with any other steel reinforcement, such as mesh, which may be required to withstand the structural loads subsequently to be imposed on the unit. A mixture of water and a composition containing gypsum, in accordance with one of the examples to be described later, is then poured into the space between the core 19 and the side walls 21 through a movable inlet pipe 25. The mixture is poured in until it reaches the level of the top of the core 19. The frame 16 has fixing lugs projecting upwards from it and these lugs are cast into the mixture poured into the mould.

Figure 6B:
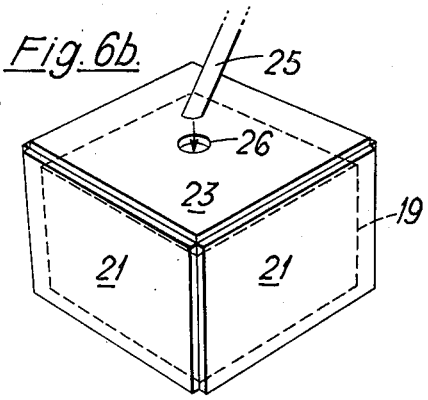

As soon as the mixture reaches the top of the core 19, the supply shut-off and the pipe 25 is removed. The top 23 is then lowered as shown in FIG. 6*b* and further mixture which may be the same as that previously supplied, but in this example is of a stronger mix, is supplied through the pipe 25 and through an opening shown diagrammatically at 26 in the top 23 of the external mould. This further mixture forms the top 1 of the unit together with the integral diagonal beams 11.

Figure 6C:
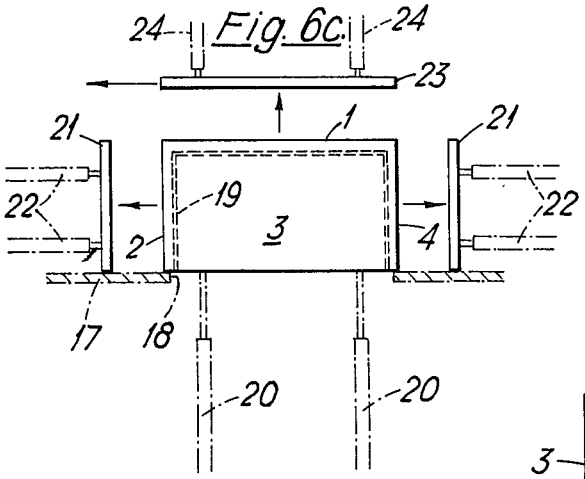
Figure 6E:
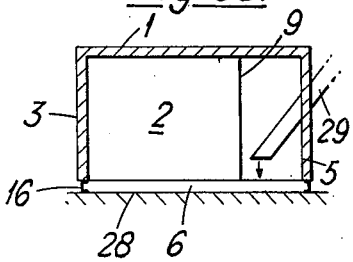

At this stage the mixture is allowed to set and as soon as it has gained sufficient compressive strength for the side walls of the unit to be self supporting, the sides 21 and the top 23 of the external mould are retracted as shown in FIG. 6*c*.

At this stage the mixture is allowed to harden further for a time after the start of the removal of the external mould which is greater than that which elapses between completion of the casting of the top 1 and the retraction of the sides and top of the mould. During this time, a temperature gradient builds up through the thickness of the side walls and top of the unit because the core 19 is coated with polyethylene or polytetrafluoroethylene to provide it with a coefficient of heat reflection which is substantially greater than that of the metal surfaces of the side walls 21 and the top 23.

Owing, it is thought, to this temperature gradient, the sides 2 to 5 and the top 1 of the cast unit expand away from the faces of the core 19 to provide a gap between the internal flat faces of the side walls 1 to 5 and the top 1 and the core as shown diagrammatically by the the double-dotted lines in FIG. 6*c*.

Figure 6D:
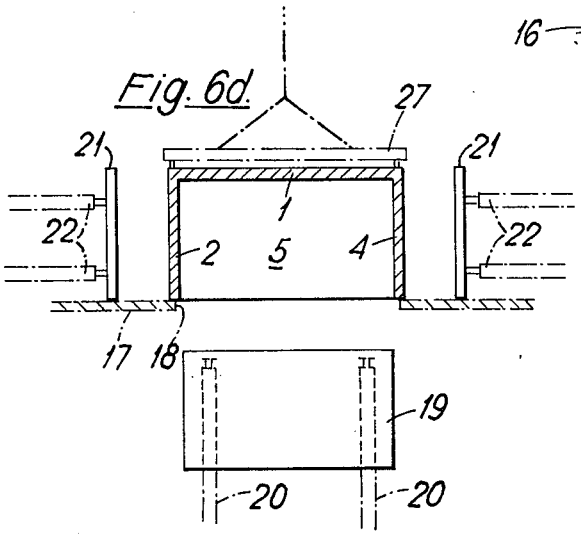

When the mixture has hardened sufficiently to make the top 1 self supporting, the core 19 is lowered by retracting the rams 20 as shown in FIG. 6*d*. A lifting beam 27 is then moved into position and is attached by cables or other ties to the channel-sectioned frame 16. The open-bottom unit is then lifted clear of the side walls 21, is moved laterally and is then lowered onto a bottom mould 28, the upper face of which is shaped to form the ribbed underside of the floor 6. As shown, the frame 16 rests in close contact with the mould 28 and then a further mixture supply pipe 29 is introduced through the door opening 9 and further mixture is supplied to form the floor 6. In this example, the mixture used to form the floor 6 is the same as that used for the top 1 and it is of such a fluid nature that it flows freely to provide a smooth level upper surface for the floor. The mixture flows into the channel-sectioned frame 16 to form a key to fix the floor to the side walls 2 to 5 as shown most clearly in FIG. 5 of the drawings.

As soon as the floor 6 has gained sufficient strength, the box-like unit is complete and can be removed to a storage area to allow it to gain further strength and to enable it to be fitted out with the internal fixtures and fittings eventually required in the room or other space in a building which will eventually be formed by the unit.

In the modification of the method just described illustrated in FIG. 7, the casting floor 18 has no opening and a core 19′ is not movable upwards and downwards, but is instead made so that it can be moved horizontally along the floor 18. Further, a side wall 21′ is pivotally mounted so that it can be swung as indicated by an arrow 30 and, after completion of casting and sufficient hardening of the unit, the side walls 21 and 21′ are retracted, the side wall 21 is swung into the position shown in FIG. 7 and the unit is moved laterally out of the mould on the core 19′. Another core is then moved into position in the mould which can immediately be used again. As soon as the unit on the core 19′ has hardened sufficiently, it is lifted from the core by means of a lifting beam similar to the beam 27 and it is then placed on the bottom mould 28.

The core 19 is constructed as shown in FIG. 8 and comprises four side walls 31 a top 32 and a bottom 33 which are cast from a mixture of super-gypsum and water. The side walls, the top and bottom are cast separately and are reinforced with steel mesh reinforcement as indicated at 34 as necessary. The separate walls and top and bottom are subsequently fixed together along their edges, and corner junctions are separately cast on to provide smooth and continuous side and top external surfaces. After casting, access is gained to the inside of the core through an opening 35 and a Gunite layer of sand and cement mortar 36 is applied. At the same time as the Gunite layer 35 is applied, form work is erected to enable stiffening ribs 36 also to be formed by Gunite spraying.

The bottom 33 of the core is provided with four recesses, two of which are shown at 36 and air lift pads are subsequently installed in these recesses. These air lift pads enable the core to be moved laterally on a smooth flat surface very easily while supported on air cushions formed by the pads in the manner of an air cushion vehicle. The side and top of the core are sprayed with a polyethylene coating.

Examples of mixtures which may be used for casting the unit are as follows:

EXAMPLE 1

| Parts by Weight | Material |
|---|---|
| 100 | Super-Gypsum |
| 23 | Water |
| 0.5 | Sisal |
| 0.1 | Foaming Agent |
| 0.25 | Gum Arabic (plasticiser) |
| 0.1 | Wetting Agent |
| 0.5 | Retarding Agent (Sodium Citrate) |

This mixture gives a wet strength of 6,000 psi, a dry strength of 14,000 psi, a density of 125 pcf dry and a linear expansion of 0.3%.

The actual expansion achieved from the core after removal of the external mould in the course of the method in accordance with the invention is substantially greater than this

EXAMPLE 2

| Parts by Weight | Material |
|---|---|
| 50 | Middle Gypsum |
| 50 | Portland Cement |
| 40 | Water |
| 0.5 | Sisal |

Additives as in Example 1.

This mixture gives a wet strength of 3,000 psi, a dry strength of 5,000 psi a density of 100 pcf dry and an expansion of 0.05%.

EXAMPLE 3

| Parts by Weight | Material |
|---|---|
| 50 | Middle Gypsum |
| 25 | Portland Cement |
| 25 | Ordinary Gypsum (Plaster of Paris) |
| 60 | Water |
| 0.5 | Sisal |

Additives as in Example 1.

This mixture gives a wet strength of 1300 psi, a dry strength of 2,500 psi, a density of 77 pcf dry and a linear expansion of 0.09%.

EXAMPLE 4

| Parts by Weight | Material |
|---|---|
| 50 | Middle Gypsum |
| 50 | Portland Cement |
| 35 | Water |
| 0.5 | Sisal |

Additives as in Example 1.

This mixture gives a wet strength of 2,500 psi, a dry strength of 3,500 psi, a density of 85 pcf dry and a linear expansion of 0.04%.

EXAMPLE 5

| Parts by Weight | Material |
|---|---|
| 50 | Middle Gypsum |
| 25 | Portland Cement |
| 25 | Ordinary Gypsum |
| 42 | Water |
| 0.5 | Sisal |

Additives as in Example 1.

This mixtue gives a wet strength of 1500 psi, a dry strength of 3000 psi, a density of 85 pcf dry and a linear expansion of 0.06%.

EXAMPLE 6

| Parts by Weight | Material |
|---|---|
| 50 | Middle Gypsum |
| 25 | Portland Cement |

-continued

| Parts by Weight | Material |
|---|---|
| 25 | Ordinary Gypsum |
| 62 | Water |
| 0.5 | Sisal. |

This mixture gives a wet strength of 300 psi, a dry strength of 850 psi, a density of 54 pcf dry and a linear expansion of 0.05%.

In the example described with reference to the drawings, the side walls of the units are formed from a mixture in accordance with Example 3 and the top and bottom are formed from a mixture in accordance with Example 4.

The mixture used, however, depends entirely upon the strength required of the finished unit and, in the case of units for use in pre-fabricated building construction, this would depend mainly upon the number of storeys which the building in which the units are used is to have.

The properties of a mixture in accordance with Example 1 are illustrated by the graphs shown in FIGS. 9 to 11. From FIG. 9 it will be seen that the mixture reaches a compressive strength of just over 2,000 psi within 40 minutes after mixing and at this time, as shown in FIG. 10, the temperature of the mixture has increased by 100°F from the temperature at the time of mixing and as shown in FIG. 11, an expansion of approximately 0.3% has taken place.

Using the somewhat weaker mixtures set out in Examples 3 and 4, the stages of the method illustrated in FIGS. 6*a* to 6*d* may take place at the following times:

0–5 minutes preparing mixture (temperature 82°F)

5–10 minutes filling side walls and top of mould 20 minutes testing initial set (temperature 90°F) strength 20 psi.

25–28 minutes removal of external mould (temperature 100°F) strength 1700 psi.

41–43 minutes remove core (temperature 181°F) strength 2100 psi.

46 minutes lift box from casting position (temperature 181°F) strength 2,200 psi.

We claim:

1. A method of making a box-like unit having at least one open side, said method including the steps of preparing a mixture of water and a composition including a hydraulic binding agent consisting at least partly of gypsum, casting said mixture between an external mould defining the external faces of said unit and an internal core having fixed peripheral dimensions defining the internal faces of said unit, at least those surfaces of said core which come into contact with said mixture being covered by a material having a higher coefficient of heat reflection than those surfaces of said external mould which come into contact with said mixture, the quantity of gypsum in said composition being sufficient to produce an exothermic reaction between said composition and said water which produces a tendency in said mixture to expand outwardly away from the heat reflecting material covering said core, allowing said mixture to set until self-supporting and then promptly removing only said external mould, allowing said mixture to further harden while substantially unrestrained against outward expansion in response to said exothermic reaction until such expansion permits said core to be removed from said mould without altering said peripheral dimensions, and subsequently so removing said internal core through said open side of said unit while said mixture is still so heated by said exothermic reaction, the time which elapses between the start of the removal of said external mould and the start of the removal of said core being greater than the time which elapses between the completion of casting of said mixture and the start of the removal of said external mould.

2. A method as claimed in claim 1, wherein said internal core includes a rigid base structure and a coating of polyethylene or polytetrafluoroethylene on those faces of said core which come into contact with said mixture.

3. A method as claimed in claim 1, wherein said unit is rectangular, and further comprising the step of casting said unit with said open side lowermost, and removing said core from said cast unit by bringing about relative vertical movement between said core and said unit.

4. A method as claimed in claim 3, wherein said unit includes side walls and a top wall and said external mould comprises sides and a top, said side walls of said unit being cast with said top of said external mould absent and, immediately after casting said side walls, said top of said external mould is placed in its operative positive and said top wall is cast.

5. A method as claimed in claim 4, comprising casting said side walls with a mixture including a first composition and subsequently casting said top wall with a mixture including a second composition, said top wall having a greater compressive strength than that of said side walls after setting and hardening of said mixtures.

6. A method as claimed in claim 5, further comprising the steps of forming at least one opening in a side wall of said unit and, after removing said core, casting a further wall closing the open side of said unit.

7. A method as claimed in claim 6, wherein said further wall is cast from the same mixture as said top wall.

8. A method as claimed in claim 1, wherein said composition contains a major proportion of gypsum.

9. A method as claimed in claim 8, wherein said gypsum includes at least some high-strength super gypsum.

10. A method as claimed in claim 8, wherein said composition contains from ½ to 1½% by weight of fibrous reinforcement.

11. A method as claimed in claim 10, wherein said fibrous reinforcement is sisal.

12. A method as claimed in claim 8, in which the fibre length of said fibrous reinforcement is aobut 1¼ inches.

* * * * *